US005206068A

United States Patent [19]

Kalkanoglu

[11] Patent Number: 5,206,068

[45] Date of Patent: Apr. 27, 1993

[54] SURFACING FOR POLYMER MODIFIED OR UNMODIFIED BITUMEN ROOFING MEMBRANES

[75] Inventor: Husnu Kalkanoglu, Swarthmore, Pa.

[73] Assignee: Tarmac Roofing Systems, Inc., Wilmington, Del.

[21] Appl. No.: 775,552

[22] Filed: Oct. 15, 1991

[51] Int. Cl.[5] ..... B32B 11/02; B32B 11/12; D06N 5/00

[52] U.S. Cl. ..... 428/143; 428/141; 428/144; 428/145; 428/150; 428/489; 428/281; 428/40

[58] Field of Search ..... 428/143, 141, 144, 145, 428/150, 489, 281, 40; 156/337, 71

[56] References Cited

U.S. PATENT DOCUMENTS

| | | | |
|---|---|---|---|
| 2,054,317 | 9/1936 | Gundlach | 428/281 |
| 4,055,453 | 10/1977 | Tajima et al. | 428/142 X |
| 4,248,926 | 2/1981 | Tajima et al. | 428/343 X |
| 4,357,377 | 11/1982 | Yamamoto | 428/141 X |
| 4,386,981 | 6/1983 | Clapperton | 428/143 X |
| 4,636,414 | 1/1987 | Tajima et al. | 428/489 X |
| 4,749,731 | 6/1988 | Kyminas et al. | 428/146 X |
| 4,757,652 | 7/1988 | Kalkanoglu | 52/748 X |
| 4,859,723 | 8/1989 | Kyminas et al. | 428/146 X |
| 5,142,837 | 9/1992 | Simpson et al. | 428/141 X |

*Primary Examiner*—George F. Lesmes
*Assistant Examiner*—D. R. Zirker
*Attorney, Agent, or Firm*—Levy, Zito & Grandinetti

[57] ABSTRACT

Fine quartzite particles with a colored ceramic coating are used for surfacing roofing membranes to enable easier lapping of the roofing membranes while still maintaining necessary UV and heat protection. The roofing membranes may include modified and unmodified bitumen compositions that may be applied to roofing surfaces using heat welding, hot asphalt, cold adhesive, self adhesion and the like.

8 Claims, No Drawings

SURFACING FOR POLYMER MODIFIED OR UNMODIFIED BITUMEN ROOFING MEMBRANES

BACKGROUND OF THE INVENTION

The present invention relates to surfaced modified or unmodified bitumen roofing membranes or sheets that are readily overlapped and sealed. More particularly, the present invention relates to the use of particular type of fine surface granules on roofing membranes that enable easy overlapping and sealing between roofing membrane sheets while providing UV and heat protection to the roofing membranes.

DESCRIPTION OF THE PRIOR ART

Various types of roofing products have been provided as for example as shown in prior U.S. Pat. Nos. 4,278,470; 3,931,440; 4,079,158; 4,405,680; 2,054,317; 4,082,885; and 4,757,652. However, none of these prior patents nor any others known to applicant achieve the results accomplished by the present invention.

SUMMARY OF THE PRESENT INVENTION

A primary object of the present invention is to provide fine surfacing granules to be used on any bitumen roofing membrane.

Another object of the present invention is to provide a polymer modified bitumen roofing membrane wherein fine color coated quartzite particles are used on any roofing products which are self adhesive to the roof surface after the protective film or paper which is treated with a release agent on the protective back is peeled off.

A still further object of the present invention is to provide polymer modified or unmodified bitumen roofing membranes that can be made and used with maximum efficiency.

These and other objects and advantages will appear more fully hereinafter and for purposes of illustration and not of limitation, an embodiment of the invention is described herein.

DESCRIPTION OF THE PREFERRED EMBODIMENT

Modified bitumens (MB) were developed in Europe during the late 1960's for roofing applications and found a market in the United States during the 1980's. These products are now being produced in the United States by several manufacturers, and have become an important part of the roofing industry. The use of unmodified (conventional) roofing membranes on the other hand go back to the 1920's.

Conventional roofing membranes are usually made up of glass fiber or organic felt reinforcement saturated and coated with limestone filled oxidized asphalt.

A wide variety of polymers can be utilized to modify the bitumen, but the most commonly used modifiers are atactic (amourphous) polypropylene (APP), polypropylene-ethylene copolymers, polyethylene, polyoxyethylene, styrene-butadiene-styrene copolymer (SBS), styrene-ethylene-butylene-styrene copolymer (SEBS), and styrene-isoprene-styrene copolymer (SIS). In general, these polymers improve the flow resistance of the bitumen at elevated temperatures and flexibility at low temperatures.

As a result of the vast improvement that these polymers provide, polymer modified bitumen blends can now be used to produce prefabricated waterproofing sheets that are suitable for single layer installation. The finished membranes provide a broader range of service temperatures and have superior resistance to roof movements, cyclic fatigue, and thermally or mechanically induced stresses on the roof compared to conventional build up roofing (BUR). In addition, modified bitumen membranes are lighter than BUR. BUR has to be protected on the exposed surface by field applied gravel, ballast or coatings against the detrimental effects of sun rays (UV) and heat. Modified or unmodified bitumen roofing membranes are supplied with factory applied surfacing such as roofing granules, metal foil, polyfilm, talc, sand, or other fine mineral matter.

Roofing granules have architectural and technical importance. They provide the membrane products not only with a finished colored surface, but at the same time protect the bitumen coating on the product against UV, heat (light colored granules reflect heat), and to some degree, foot traffic.

Conventional unmodified roofing membranes are adhered to the roof by either mopping or cold adhesive techniques.

Modified bitumen roofing membranes are applied onto the roof surface currently in four methods.

1. Heat welding-propane torch or hot air
2. Hot asphalt-mop or pour
3. Cold adhesives-asphaltic mastic
4. Self-adhere-peel and stick The MB roofing sheets are adhered to the roof substrate and overlap each other by 3–4 inches along their sides, and 4–6 inches at their ends. During the production, roofing granules are not applied along the side lap of the MB roofing membrane to create the 3–4 inch wide selvedge. This area is surfaced by either sand-like fine mineral matter or poly film. Hence, when the modified bitumen roofing sheets are overlapped along the side laps using any of the four above listed methods, a water tight seal can be easily obtained. However, it is not practical and feasible to repeat the same selvedge at the ends of the MB membranes because they are produced as a continuous sheet on a roofing line and are later cut down to individual pieces and wound in rolls of various lengths.

Fusing the 4–6 inch granule surfaced end laps of MB membranes on a roof is not an easy task. Lapping two MB sheets along their ends creates the weakest link on the membrane application. There are voids between the granules that have to be completely filled with the modified bitumen coating (torch application, or self adhered) or hot asphalt (mop application) or mastic (cold adhesive application), so that the created 4–6 inch wide seam is completely water tight and will remain so during the entire service life of the membrane. If the products are torch applied to the roof, manufacturers have to make certain that there is a sufficient quantity of coating on the back of the sheet to fill the voids between the granules. Some applicators even go to the extent of first torching a 2–4 inch wide modified bitumen strip on the granules at the ends first, and then, torching overlaying membrane over the strip thus using the strip as a void filler to ensure proper bond between the two layers of MB membranes. In the case of self adhering membranes, a majority of manufacturers shy away from producing granular products since independent of how sticky or tacky the membrane's back surface may be, the adhesive back coating cannot flow and deform to completely seal the end laps.

These problems could be minimized if smaller granules were used. Since the colored roofing granules can be obtained only in one size, other sources had to be considered. Fine mineral matter, such as slag fines or sand either do not offer the color selection that factory colored roofing granules do, or being partially or totally translucent they do not provide the modified bitumen membranes the UV and heat protection that is still necessary. However, it has now been discovered that all these properties can be obtained from a product which primarily consist of fine quartzite particles that are crushed and/or screened before they are coated with a colored ceramic coating.

Table I below shows the particle size distribution of traditional No. 11 roofing granules, and coated quartzite particles of the present invention.

TABLE I

| | % by Weight Retained | |
|---|---|---|
| U.S. Sieve Size | No. 11 Roofing Granules | Grade 28 Coated Quartzite Particles |
| 12 | 4–10 | 0 |
| 16 | 30–45 | 0 |
| 20 | 25–35 | 0–1 |
| 30 | 14–24 | 5–15 |
| 40 | 2–9 | 50–70 |
| 50 | 0–1 | 15–30 |
| 70 | 0–1 | 0–5 |
| −70 | 0–2 | 0–1 |

Colored quartzite particles that are suitable for use as the surfacing material for bitumen roofing membranes of the present invention can be obtained from companies such as 3M, Co., under the tradename "Colorquartz", or Clifford W. Estes Co., Inc. under the tradenames Broadcast (Medium an Fine) and Trowel-Rite. These products have been so far sold primarily for seamless flooring, swimming pools, aquariums, architectural surfaces, etc. and never been commercially sold for roofing membranes except until now. Modified bitumen roofing products that were produced using these granules were found to be 6–10 lbs lighter than the identical products produced utilizing No. 11 roofing granules. The quartzite particles offer a large spectrum of colors. Being much smaller in size as Table I shows, when used on modified bitumen roofing sheets, application via torching or self adherence becomes much easier, since there are no large voids to fill between the particles. Therefore it is possible to create more sound, and watertight roofs that are less sensitive to applicator errors. These particles can be used to cover the entire surface of the modified or unmodified bitumen roofing membrane, or the membrane can have a 1–7 inch selvedge along its entire length, which then can be surfaced by fine mineral matter such as talc, sand, or slag fines, or poly film or paper. The last two can be either permanently attached to the membrane or treated with a release agent to allow them to be peeled off before the finished product is applied on the roof.

With the present invention, crushed and/or screened quartzite to which has been applied a colored ceramic coating can be used to provide color and aesthetic architectural effects on roofs.

Specifically, the present invention is directed to the use of fine surfacing granules on any bitumen roofing membrane. The granules are actually pigment coated sand particles, several colors being available, and have found conventional use on seamless flooring, aquariums, swimming pools, and the like. The invention in the present application is the first to use these granules for roofing membranes.

The composition of the granules is ceramic coated, colored, inorganic quartz granules. The translucent quartz granules are colored with permanent pigments that are ceramically bonded to the surface. The user can create his or her own color blends. Various colors can be matched to the user's specifications. The present invention provides brilliant colors and good quality control is assured. The roofing products will have high durability when made in accordance with the present invention, and will also be characterized by their economy and beauty, and low maintenance is assured.

The particles can be made of any suitable material and in different shapes and sizes. It will be seen that in accordance with the present invention, color coated quartzite particles can be used on any polymer modified bitumen roofing product which is intended to be applied to roof surfaces by heat welding, hot asphalt, or cold adhesive techniques. The same particles are suitable as a surfacing for conventional unmodified asphalt roofing membranes as well, which are applied to roof surface primarily by hot asphalt or cold adhesive techniques. The present invention is also directed to the use of color coated quartzite particles on any roofing product which is self adhered to the roof surface after the protective film or paper which is treated with a release agent on the back of the product is peeled off. Further, the roofing membranes can have these quartzite particles covering their entire surface, or can have a 1–7 inch wide side lap (selvedge) along their length which is surfaced with fine mineral matter such as mica, talc, sand, slag, and the like. This selvedge can also be surfaced with a poly film, such as polyethylene, or polypropylene film. This film can be either permanently attached to the side lap, or can be treated with a release agent to allow the film to be peeled off before the membranes are overlapped on the roof. If a peeled selvedge protection is chosen, instead of film, paper can be also used.

It will be understood that various changes and modifications can be made in the details of procedure, formulation and use, without departing from the spirit of the invention, especially as defined in the following claims.

I claim:

1. A light weight bitumen roofing membrane with improved sealing properties for adhesion to a roof substrate, wherein said roofing membrane has the form of long sheets and is adapted to be applied to said roofing substrate by overlapping approximately 3 to 4 inches along the sides of the sheets and approximately 4 to 6 inches along the ends of the sheets to form a water tight seal, said bitumen roofing membrane comprising a bitumen roofing sheet comprising a felt reinforcement saturated and coated with bitumen, said bitumen roofing sheet having an outer surface and an inner surface;

an exposed roofing surface comprising fine quartzite particles coated with a colored ceramic coating said particles being in the range of about 30 to 50 U.S. Sieve Size adhered to said outer surface; and adhesion means applied to said inner surface for adhering said bitumen roofing membrane to a roof substrate.

2. The bitumen roofing membrane of claim 1 wherein said bitumen is a polymer-modified bitumen.

3. The bitumen roofing membrane of claim 2 wherein said polymer-modified bitumen modified with a polymer is selected from the group consisting of atactic (amorphous) polypropylene (APP), polypropylene-ethylene copolymers, polyethylene, polyoxyethylene, styrene, butadiene-styrene block copolymer (SBS), styrene-ethylene-butylene-styrene block copolymer (SEBS), and styrene-isoprene-styrene block copolymer (SIS).

4. The bitumen roofing membrane of claim 1 further comprising a selvedge located along one side of said outer surface.

5. The bitumen roofing membrane of claim 4 wherein said selvedge is from about 1 inch to about 7 inches.

6. The bitumen roofing membrane of claim 5 wherein said selvedge is surfaced by fine mineral matter.

7. The bitumen roofing membrane of claim 5 wherein said selvedge is surfaced with a polyolefin film.

8. The bitumen roofing membrane of claim 1 wherein said adhesion means is a self adhesion strip.

* * * * *